US005738492A

United States Patent [19]

Stanko et al.

[11] Patent Number: 5,738,492

[45] Date of Patent: Apr. 14, 1998

[54] CONSTANT VELOCITY AIR FOIL

[75] Inventors: John Stanko, Bayonne; Scott Febo, Union Beach, both of N.J.

[73] Assignee: White Consolidated Industries, Inc., Cleveland, Ohio

[21] Appl. No.: 677,106

[22] Filed: Jul. 9, 1996

[51] Int. Cl.[6] ..... F01D 1/02

[52] U.S. Cl. ..... 415/211.1; 415/211.2; 415/212.1

[58] Field of Search ..... 415/203, 204, 415/211.1, 212.1, 211.2; 62/262

[56] References Cited

U.S. PATENT DOCUMENTS

| | | | |
|---|---|---|---|
| 249,802 | 11/1881 | Smith | 415/211.1 |
| 2,989,855 | 6/1961 | Thompson | 62/262 |
| 3,442,092 | 5/1969 | Pratt | 415/211.1 |
| 3,680,328 | 8/1972 | McCarty | 62/262 |
| 3,940,215 | 2/1976 | Hori et al. | 62/262 |
| 4,944,654 | 7/1990 | Chou et al. | 415/204 |
| 5,399,068 | 3/1995 | Park | 415/211.2 |

*Primary Examiner*—Thomas E. Denion

*Attorney, Agent, or Firm*—Pearne, Gordon, McCoy & Granger LLP

[57] ABSTRACT

An air-conditioning unit including a centrifugal blower for centrifugally blowing air having a generally horizontal axis a rotation and a scroll having an elongated discharge plenum above the blower and an air guide about the blower for directing air exiting the blower to the discharge plenum through a discharge port having first and second ends. The air guide has a radius from the rotational axis of the fan which increases from a cutoff point near the first end of the discharge port to the second end of the discharge port. The scroll also has a curved air foil located above the blower and to a side of the blower toward the second end of the discharge port. The air foil has a leading edge near the blower and a trailing edge in the discharge plenum effective to divert a portion of air exiting the blower toward the second end of the discharge port to equally distribute air across the discharge plenum. The air foil intersects the discharge port near the lateral center of the discharge port and near the center of the air foil. Preferably, the air-foil is either forwardly curved or double-curved.

21 Claims, 6 Drawing Sheets

12
138
134
32
132
136
10
30
108
142
140
142
50
144
56
42
34
26
44
146
38
24
20
36
28
40
22

CONSTANT VELOCITY AIR FOIL

BACKGROUND OF THE INVENTION

1. Field of the Invention

The present invention generally relates to room air-conditioning units having centrifugal fans or blowers and, more particularly, to compact room air-conditioning units having air foils for directing air from the blowers so that exiting air has a constant velocity pattern across the exhaust grilles.

2. Description of Related Art

Room air-conditioning units are typically located in a window or other opening in an exterior wall of a building. The units have an indoor or front side located within a room of the building and an outdoor or rear side located outside the building. A centrifugal fan or blower draws air from the room through an inlet louver or grille and over an evaporator coil which cools the air. The inlet grille is typically at the bottom of the unit front side. Cooled air centrifugally leaves the blower at a relatively high velocity and is collected and diffused by a scroll. The cooled air is upwardly directed by the scroll to a laterally extending plenum located above the blower. The cooled air negotiates a ninety-degree turn within the plenum and exits the unit through an exhaust louver or grille to the interior of the room. The exhaust grille is located above the inlet grille on the front side of the unit.

In many room air-conditioning units, the cooled air exits the exhaust grille with an uneven air flow distribution across the front side of the unit. Typically, a larger amount of air is discharged from the right sides of the units than from the left sides of the units. This uneven flow distribution is particularly present with compact room air-conditioning units which have a scroll with a relatively tight radius to minimize the lateral length of the unit. There is a need in the art, therefore, for an air-conditioning unit having an improved distribution of air discharging from the unit.

SUMMARY OF THE INVENTION

The present invention provides an air-conditioning unit overcoming at least some of the above-noted problems of the prior art. The air-conditioning unit includes a centrifugal blower for centrifugally blowing air having a generally horizontal axis a rotation and a scroll having an elongated discharge plenum above the blower and an air guide about said the blower for directing air exiting the blower to the discharge plenum. The air enters the discharge plenum through a discharge port having first and second ends. The air guide has a radius from the rotational axis of the blower which increases from a cutoff point near the first end of the discharge port to the second end of the discharge port. The scroll also has a curved baffle or air foil located above the blower with a leading edge near the periphery of the blower and a trailing edge in the discharge plenum effective to divert a portion of air exiting the blower toward the second end of the discharge port to equally distribute air across the discharge plenum. By diverting a portion of the air to the left side of the discharge plenum, air is discharged from the unit with substantially constant velocity laterally across the unit.

In a preferred embodiment, the air foil is double-curved having a forward curved portion forming the leading edge and a backward curved portion forming the trailing edge. This air foil geometry effectively diverts air from blowers having a wide range of outer diameters. A single scroll design, therefore, can be used in air-conditioning units of varying capacity having different diameter blower wheels.

The single scroll design results in lower manufacturing costs for the air-conditioning units.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
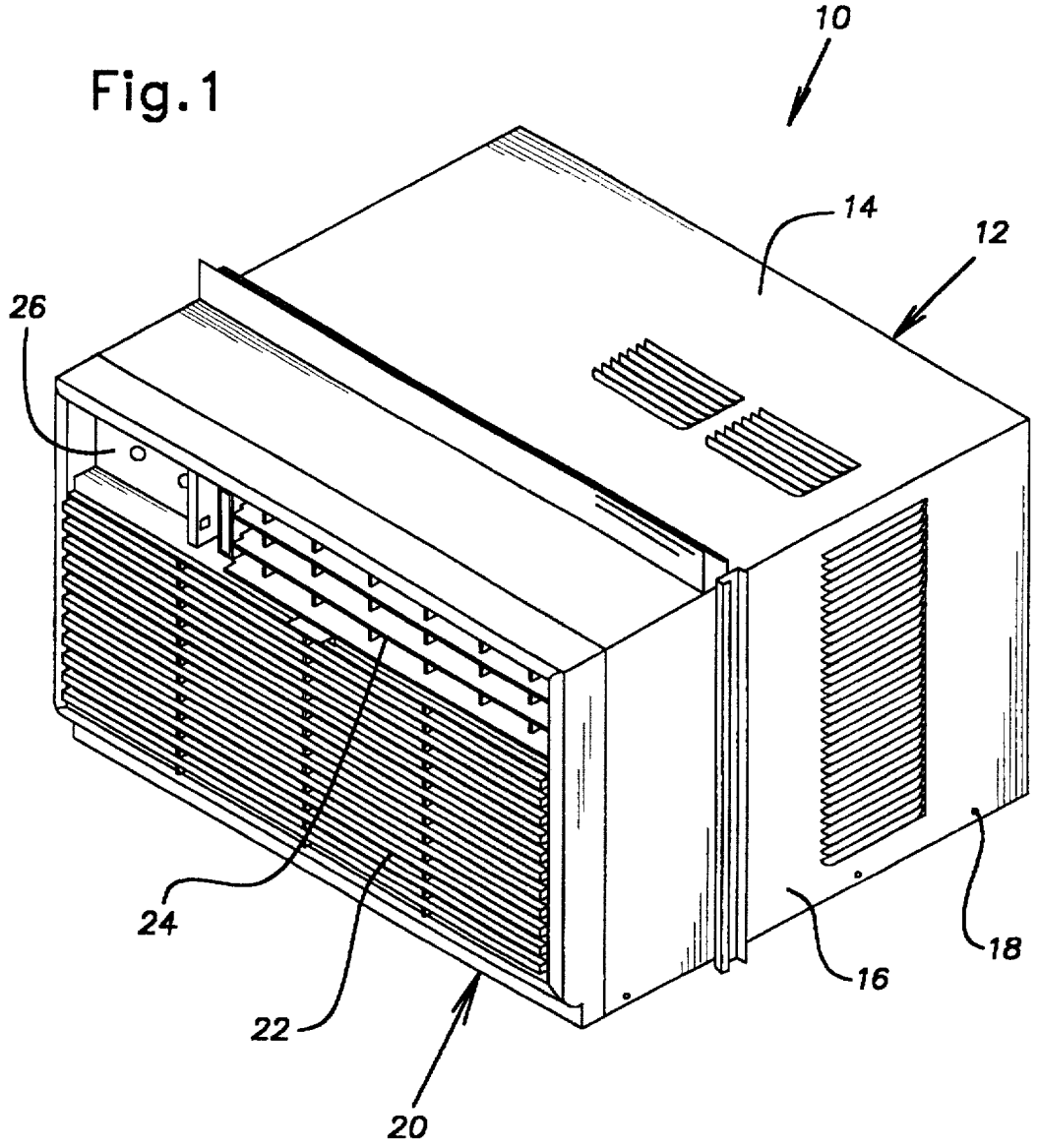
FIG. 1 is a perspective view of a compact room air-conditioning unit embodying the present invention.

FIG. 1 illustrates the overall exterior appearance of a compact room air-conditioning unit 10 incorporating the present invention. The illustrated air-conditioning unit 10 includes a one-piece sheet metal wrapper 12 providing a top surface 14 and two side surfaces 16 for the air-conditioning unit 10. The wrapper 12 is secured to the air-conditioning unit 10 by threaded fasteners 18. A molded polymeric front panel 20 provides a front surface for the air-conditioning unit 10. A lower portion of the front panel 20 has an inlet grille 22 through which air is drawn into the air-conditioning unit 10. The inlet grille 22 covers about three/fourths of the front panel 20. An upper portion of the front panel 20 has an exhaust grille 24 through which cooled air is exhausted from the air-conditioning unit 10. The upper portion of the front panel 20 also has a control panel 26 for various knobs and switches which control the operation of the air-conditioning unit 10. The front panel 20 is secured by resilient clips which are integrally molded with the front panel 20.

Figure 2:
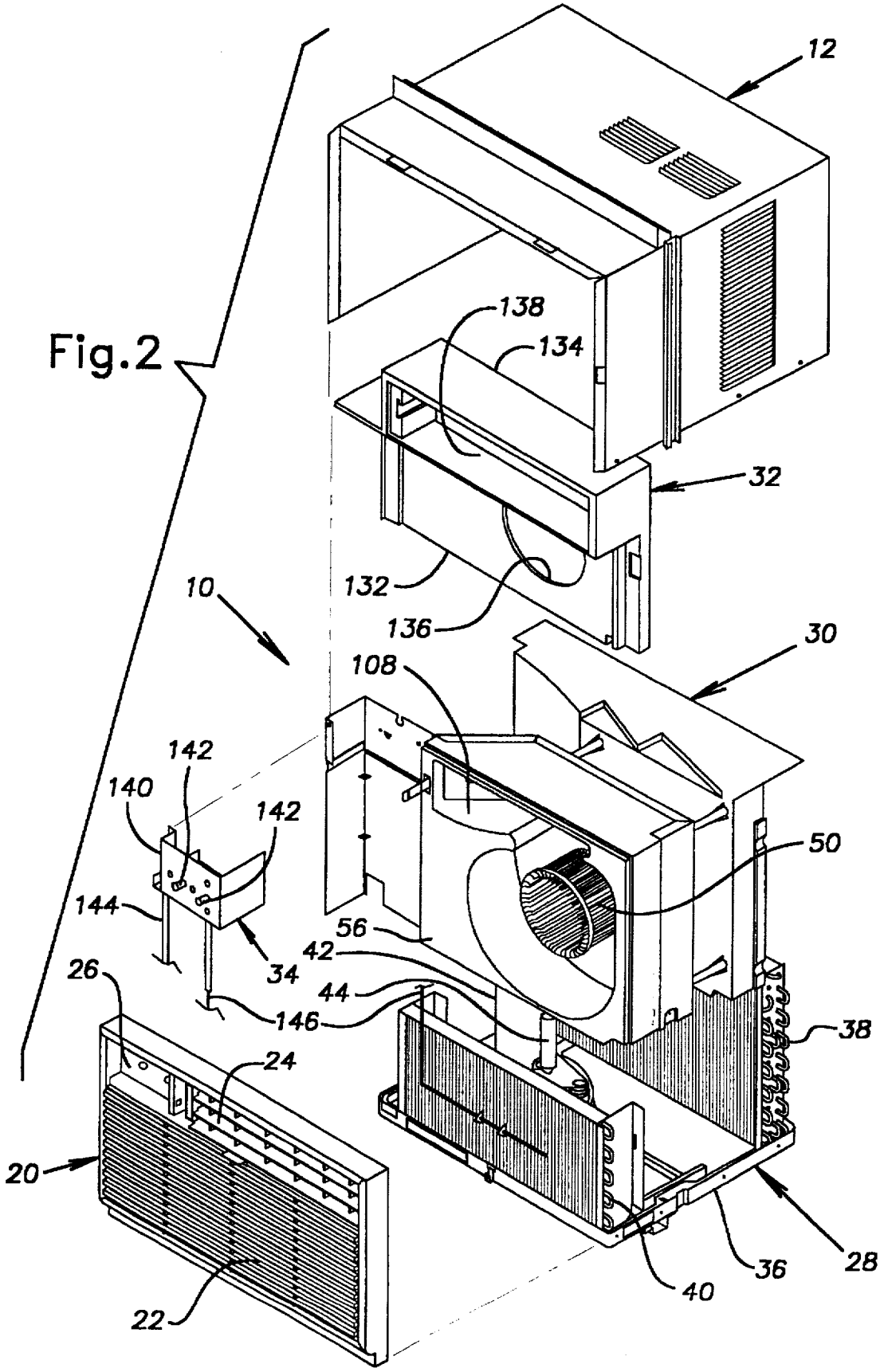
FIG. 2 is a partially-exploded perspective view of the air-conditioning unit of FIG. 1.

As best shown in FIG. 2, the air-conditioning unit 10 includes the wrapper 12, the front panel 20, a refrigeration system 28, an air handling system 30, a scroll plate 32, and an electrical control system 34. The refrigeration system 28 includes a base 36, a condenser 38 mounted vertically across the rear edge of the base 36, an evaporator 40 mounted vertically across the front edge of the base 36, a compressor 42 mounted vertically on the base between the condenser 38 and the evaporator 40 adjacent the left right side of the base 36, and a receiver 44 interconnected between the compressor 42 and the evaporater 40. The various components of the refrigeration system 28 are interconnected by tubing in a conventional manner.

Figure 3:
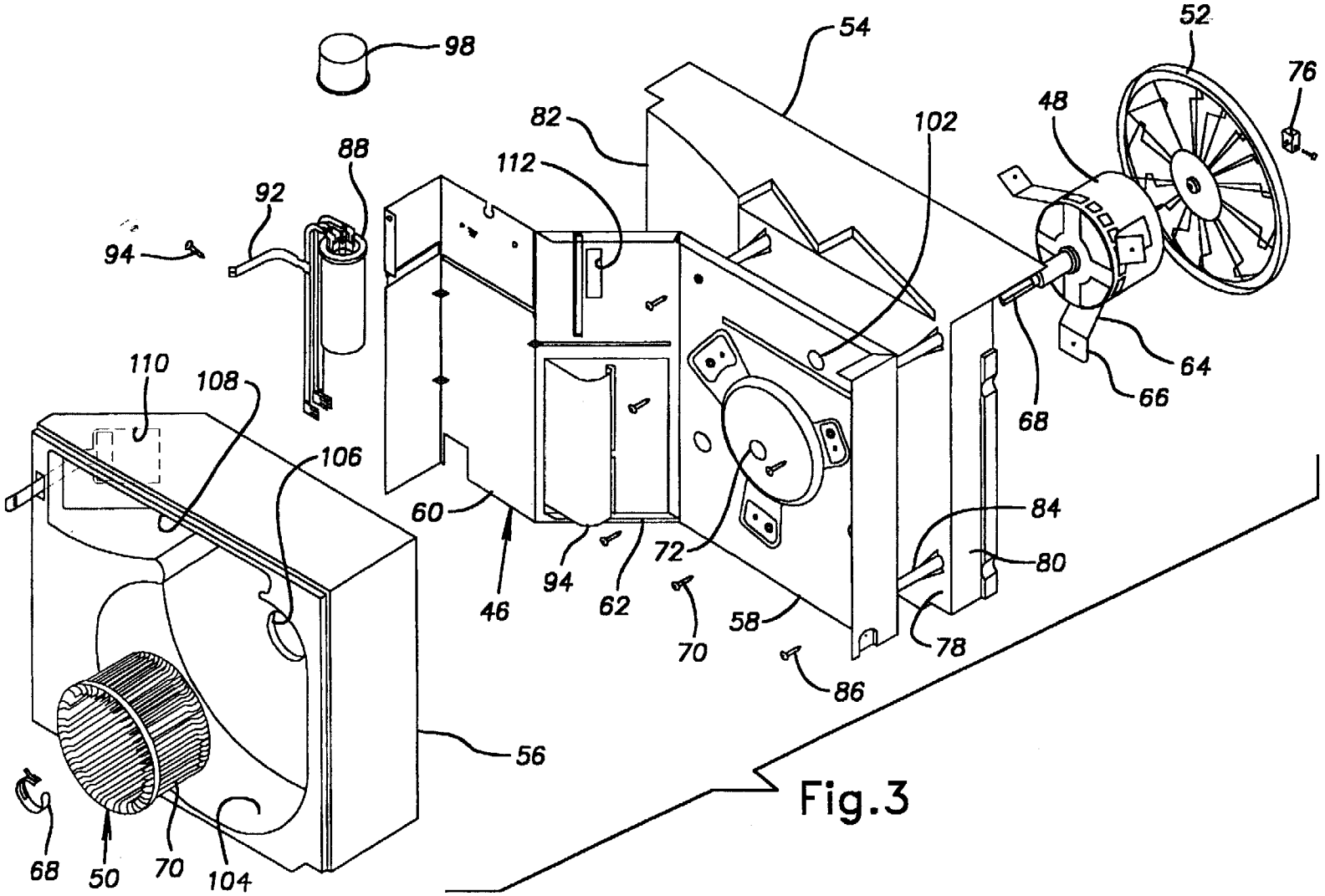
FIG. 3 is an exploded perspective view of an air handling system which is one of the components shown in exploded relation in FIG. 2.
Figure 4:
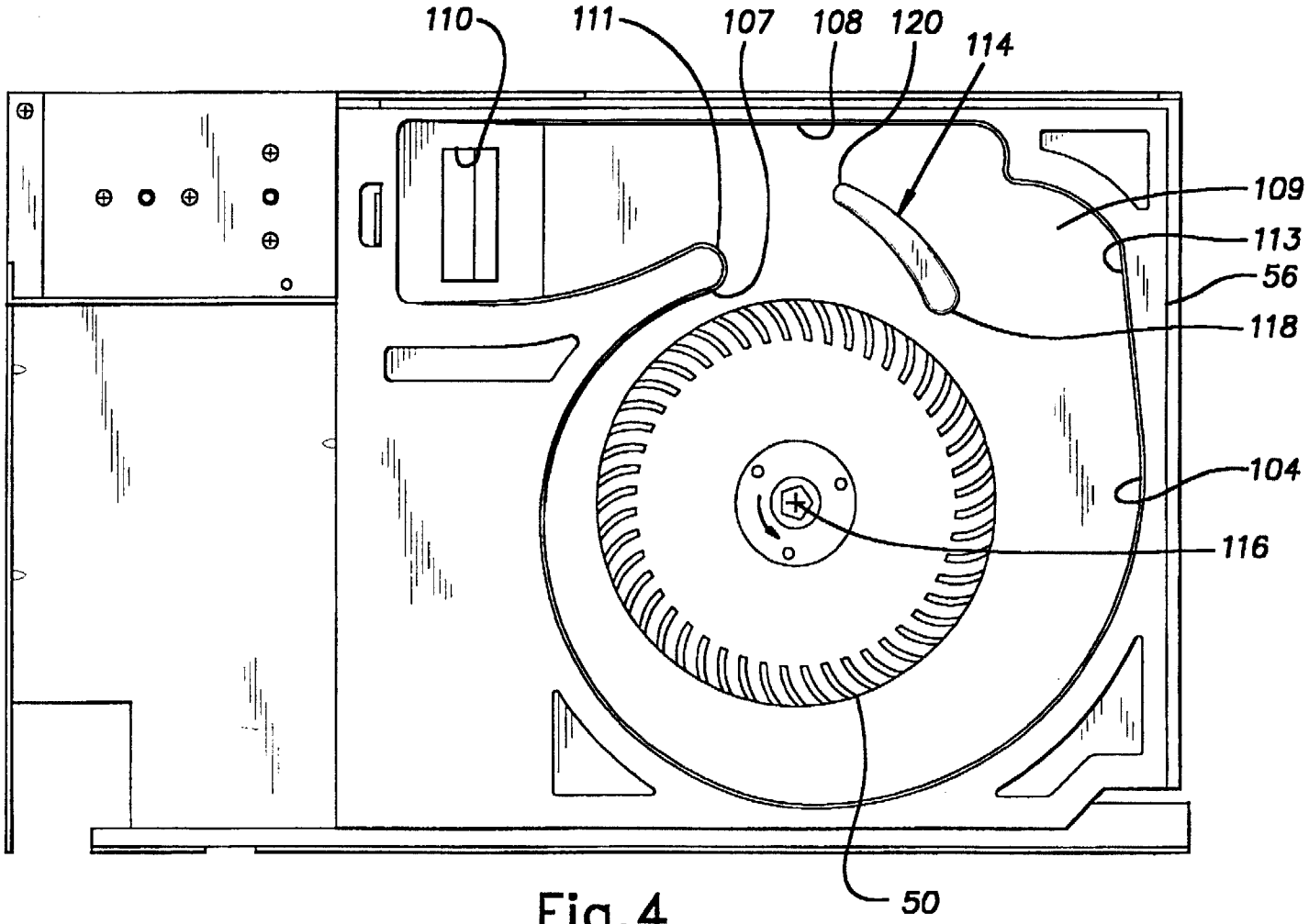
FIG. 4 is a front elevational view of the air handling system of FIG. 2.

As best shown in FIGS. 3 and 4, the air handling system 30 includes a bulkhead 46, an electric motor 48, a forward curved centrifugal fan or blower wheel 50, an axial flow condenser fan 52, a condenser shroud 54, and an evaporator scroll 56. The bulkhead 46 has a vertical main portion 58 adapted to transversely extend adjacent the left side of the air-conditioning unit 10, a vertical front portion 60 adapted transversely to extend adjacent to the right side of the air-conditioning unit 10 and spaced forward of the main portion 58, and a vertical connecting portion 62 adapted to angularly extend between the inner ends of the main portion 58 and the front portion 60. The bulkhead 46 also has vertical side portions adapted to forwardly extend from the main and front portions 58, 60 along the sides of the air-conditioning unit 10. Each of the bulkhead portions 58, 60, 62 are provided with various stiffening and mounting flanges.

The motor 48 is mounted to a rear side of the main portion 58 of the bulkhead 46. The motor 48 has three legs 64 spaced about its periphery with mounting flanges 66 at ends thereof which extend perpendicular to a shaft 68 of the motor 48. The mounting flanges 66 contact a rearward side of the bulkhead main portion 58 and are held by conventional fastening means such as sheet metal screws 70. The bulk head main portion 58 is also provided with a hole 72 through which the motor shaft 68 forwardly extends.

The blower wheel 50 is affixed on the forward end of the motor shaft 68, that is the end of the motor shaft 68 extending through the bulkhead main portion 58, whereby the blower wheel 50 is positioned adjacent the rearward side of the evaporator 40 in the assembled air-conditioning unit 10. Preferably, the blower wheel 50 is attached to the motor shaft 68 by a removable clip 74. The blower wheel 50 has a circular cross-section of a predetermined diameter and a plurality of forwardly curved vanes 51 spaced about its circumference for centrifugally blowing air.

The condenser fan 52 is mounted on the rearward end of the motor shaft 68 whereby the condenser fan 52 is positioned adjacent the forward side of the condenser 38 in the assembled air-conditioning unit 10. Preferably, the condenser fan is attached to the motor shaft 68 by a clamp assembly 76.

The condenser shroud 54 has a front wall 78 with a central round aperture sized for closely receiving the condenser fan 52 therein. The condenser shroud 54 also has rearwardly extending walls 80, 82 to generally surround the condenser 38 in the assembled air-conditioning unit 10. The condenser shroud 54 is provided with three spacers 84 spaced about the periphery of the aperture and forwardly extending from the forward side of the front wall 78. The spacers 84 contact a rearward side of the bulkhead main portion 58 and rearwardly space the condenser shroud 54 from the bulkhead 46 an adequate distance to position the motor 48 therebetween. The condenser shroud 54 is secured to the bulkhead 46 with conventional fastening means 86 such as, for example, screws which extend into the spacers 84. The condenser shroud 54 is preferably molded of a plastic material.

A capacitor 88 is electrically connected to the motor 48 by wires 90. The capacitor 88 is secured to the bulkhead 46 by a sheet metal strap 92 which cooperates with a formed flange 94 of the bulkhead connecting portion 62. The strap 92 is secured at one end by a notch arrangement and at the other end by a sheet metal screw 96. A capacitor boot 98 covers the top of the capacitor 88.

The evaporator scroll 56 is preferably molded of expanded polyfoam material having a rearward facing surface shaped to conform to the main and connecting portions 58, 62 of the forward side of the bulkhead 46. The evaporator scroll 56 is provided with three cylindrically shaped protrusions 100 (FIG. 6) which rearwardly extend from the rear side of the scroll 56. The protrusions 100 extend into openings 102 spaced about the shaft opening 72 in the bulkhead main portion 58 to securely hold and position the evaporator scroll 56 to the bulkhead 46.

Figure 6:
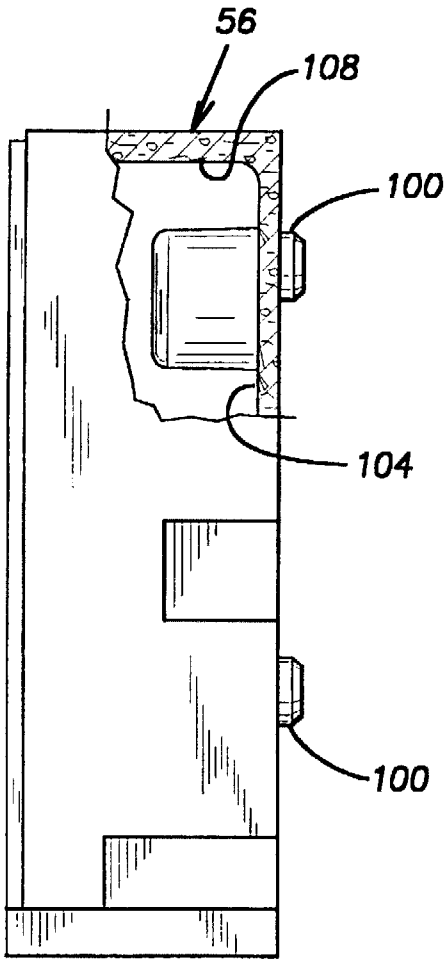
FIG. 6 is a side elevational view of the scroll of FIG. 5.
Figure 5:
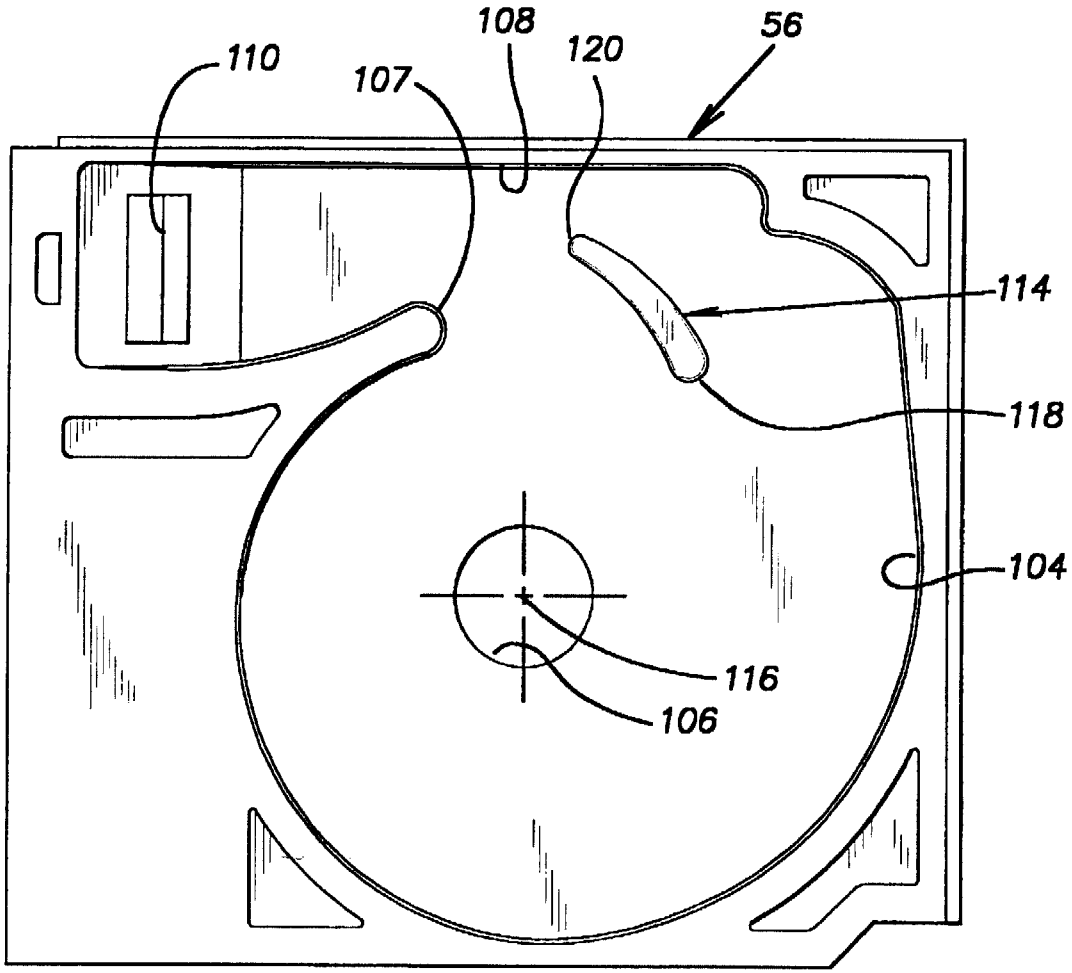
FIG. 5 is an front elevational view of a scroll of the air handling system of FIGS. 3 and 4.

As best shown in FIGS. 4, 5 and 6, the forward side of the evaporator scroll 56 forms a scroll involute or air guide 104 which receives the blower wheel 50 in the assembled air-conditioning unit 10. A central opening 106 is provided in the air guide 104 for the motor shaft 68 to pass therethrough to the blower wheel 50 when positioned in the recess 104. The air guide 104 has a cut-off point 107 above the blower wheel 50 and to the right of the rotational axis 116 of the blower wheel 50 (the down turning side) and has an increasing radius as it extends around the blower wheel 50 in the blower wheel direction of rotation (counterclockwise as viewed in FIG. 4) in a known manner. The maximum radius of the air guide 104 is preferably equal to less than about 150% of the diameter of the blower wheel 50 in order to minimize the lateral length of the unit 10. More preferably, the maximum radius of the air guide is equal to about 110% or less of the diameter of the blower wheel 50 as illustrated in FIG. 4.

An elongate discharge plenum 108 transversely extends across the top of the scroll 56 above the blower wheel 50. The air guide 104 opens into the discharge plenum through a discharge port 109. The discharge port 109 has a first end 111 near the cut-off point 107 and a second end near the maximum radius of the air guide 104. The discharge plenum 108 laterally extends past both sides of the blower wheel 50 in a direction perpendicular to the rotational axis of the fan 116. The right side of the discharge plenum 108 is provided with an opening 110 to cooperate with a vent 112 (FIG. 3) in the bulkhead connecting portion 62.

The evaporator scroll 56 includes an integrally molded baffle or air foil 114. The air foil 114 cooperates with the blower wheel 50 to distribute air entering the discharge plenum 108 so that air exits the exhaust grille 24 (FIG. 1 and 2) with a generally constant lateral distribution, that is, with a generally constant velocity laterally across the exhaust grille 24. The air foil 114 diverts a portion of the air flow toward to the left side of the discharge plenum 108, that is, toward the second end 113 of the discharge port 109 which would otherwise flow to the center or right side of the discharge plenum 108.

The illustrated air foil 114 is a forward-curved air foil, that is, an air foil 114 which is concave towards the blower wheel 50. The radius of the inner side is preferably about equal to the radius of the air guide 104 at about 35 degrees from the cut-off point 107. The radius of the outer side of the air foil 114 is preferably larger than the radius of the inner side so that the air foil 114 has a decreasing thickness from the leading edge 118 to the trailing edge 120.

The air foil 114 is laterally located entirely above the blower wheel 50 and to the left of the horizontally extending rotational axis 116 of the blower wheel 50. Preferably, the air foil 114 intersects the discharge port 109, that is, the leading edge 118 is within the air guide 104 and the trailing edge 120 is within the discharge plenum 108. The illustrated air foil 114 intersects generally the lateral center of the discharge port 109 and generally the midpoint between the leading and trailing edges 118, 120 of the air foil 114 is at the discharge port 109. The leading edge 118 of the air foil 114 is preferably positioned such that a line tangent to the leading edge 118 and perpendicular to the periphery of the blower wheel 50 is at an angle of about 45 degrees relative to horizontal. It is noted that the air foil 114 is preferably entirely over the blower wheel 50 and on a side of the blower wheel 50 toward the second end 113 of the discharge port 109.

The leading edge 118 of the air foil 114 is also positioned so that the air foil 114 is as close as possible to the outer periphery of the blower wheel 50 to get maximum interaction between the blower wheel 50 and the air foil 114. However, the air foil 114 should not be close enough to the blower wheel 50 to develop a blade pass frequency or whistling noise. It has been found that a distance equal to about 8% of the diameter of the blower wheel 50 is optimum to obtain maximum diversion of air while avoiding blade pass frequencies. Once the position of the leading edge 118 is established, the trailing edge 120 of the air foil 114 is positioned to get optimum lateral distribution of air flowing out of the scroll 56. Positioned in this manner, the trailing edge 120 is typically located to the left of the axis of rotation 116 of the blower wheel 50 and generally centered within the vertical height of the discharge recess 108.

Figure 7:
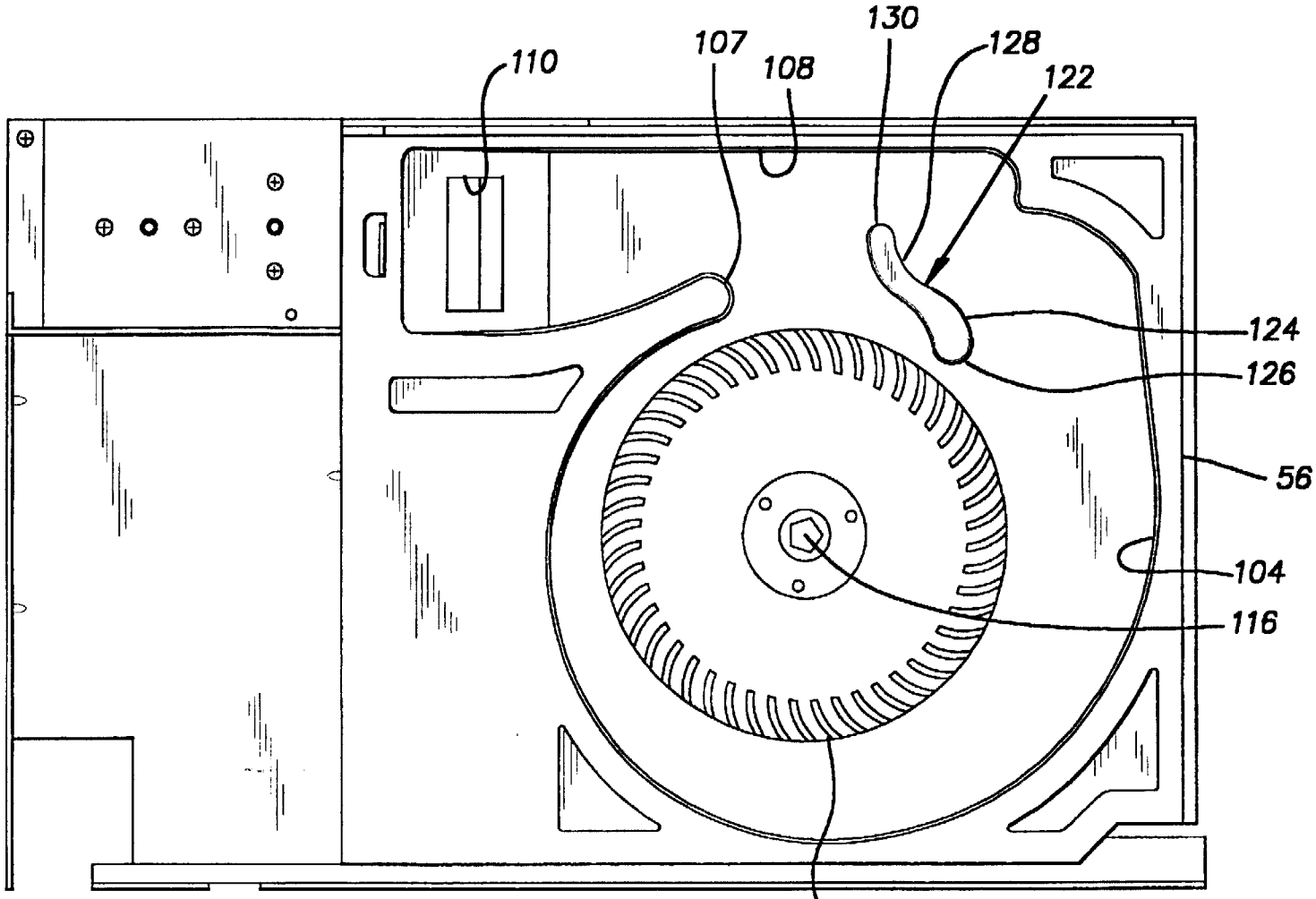
FIG. 7 is a front elevational view of a variation of the air handling system of FIG. 4.

FIG. 7 illustrates a variation of the air handling system shown in FIG. 4 wherein like reference numerals are used for like structure. The scroll 56 has an air foil 122 which is generally S-shaped, that is, the air foil 122 is double curved with a first or forward curved portion 124 forming the leading edge 126 and a second or backward curved portion 128 forming the trailing edge 130. The air foil 122 is preferably located as described above for the forward-curved air foil 114 (FIG. 4). The double-curved air foil 122 is particularly useful to obtain even air flow distribution and avoid blade pass frequencies when a common scroll 56 is used for air-conditioning units 10 having blower wheels 50 with different diameters.

Tests show, for example, that the forward-curved air foil 114 works well with 5,000 to 8,000 BTU air-conditioning units 10 having a blower wheel 50 with a diameter of about 6.1 inches. A blade pass frequency is produced, however, when the same scroll 56 is used in a 9,000 BTU air-conditioning unit 10 having a blower wheel 50 with a diameter of about 6.4 inches. It is desirable to use the same scroll 56 on air-conditioning units 10 of various sizes in order to reduce the total number of parts and resulting manufacturing costs. Tests show that a backward-curved air foil (not shown) works with the 6.4 inch blower wheel, but obtains uneven airflow distribution with the 6.1 inch blower wheel. Additionally, positioning the forward-curved air foil 114 to avoid a blade frequency with the 6.4 inch blower wheel obtains uneven air distribution with the 6.1 inch blower wheel. Tests show that the double-curved air foil 122 works well with air-conditioning units 10 having either size blower wheel 50 (diameters of 6.1 or 6.4 inches).

As best shown in FIG. 2, the scroll plate 32 is preferably molded of expanded polyfoam material having a panel portion 132 and a passage portion 134. The panel portion 132 is sized to mate with and cover the front side of the scroll 56 of the air handling system 30. The panel portion 132 is provided with an opening 136 for the passage of air into the interior of the blower wheel 50. The passage portion 134 laterally extends across the top of the scroll plate 32 and is sized and shaped to provide an air passage 138 from the discharge plenum 108 of the scroll 56 to the exhaust grille 24 of the front panel 22.

The electrical control system 34 includes a control box assembly 140 which is mounted to the top of bulkhead front portion 60 of the air handling system 30. Various shafts 142 extend from the front of the control box assembly 140 to the control panel 26 of the front panel 20. The control system 34 also includes a power cord 144 and a thermostat sensing tube 146. The power cord 144 downwardly extends from the control box assembly 140 and out the air-conditioning unit 10 to supply power to the electrical control system 34. The thermostat sensing tube 146 downwardly extends from the control box assembly 140 to the front of the evaporator 40 to measure the temperature of air coming through the inlet grille 22 of the front panel 20 to the evaporator 40.

During operation, the blower wheel 50 draws in air through the inlet grille 22. Air is cooled as it passes over the evaporator 40. Cooled air is drawn into the blower wheel 50 through the opening 136 in the scroll plate 32 and is blown from the blower wheel 50 into the scroll 56. The scroll 56 upwardly directs high velocity air exiting the blower wheel 50 to the discharge plenum 108. The air foil 114 cooperates with the blower wheel 50 to divert a portion of the air to the left side of the discharge plenum 108. The air impinges the top surface of the discharge plenum 108 and makes a sharp right-angle turn to forwardly exit the discharge plenum 108 through the passage 138 of the scroll plate 32. Cooled air is exhausted from the scroll plate passage 138 through the exhaust grille 24 of the front panel 20 with a substantially equal lateral distribution.

Although particular embodiments of the invention have been described in detail, it will be understood that the invention is not limited correspondingly in scope, but includes all changes and modifications coming within the spirit and terms of the claims appended hereto.

What is claimed is:

1. An air-conditioning unit comprising:

a centrifugal blower for centrifugally blowing air having a generally horizontal and longitudinally extending axis a rotation; and a scroll including an elongated and laterally extending discharge plenum above said blower and having first and second ends, said first and second ends of said discharge plenum being in fluid flow communication, an air guide about said blower for directing air exiting said blower to said discharge plenum through a discharge port having first and second ends, said air guide having a radius from said rotational axis of said blower which increases from a cutoff point near said first end of said discharge port to said second end of said discharge port, and a curved, tangential air foil located above said blower and extending from a rear wall of said air guide, said air foil having a leading edge near said blower and a trailing edge in said discharge plenum effective to divert a portion of air exiting said blower toward said second end of said discharge port to equally distribute air laterally across said discharge plenum.

2. The air-conditioning unit according to claim 1, wherein said air-foil is forwardly curved.

3. The air-conditioning unit according to claim 1, wherein said air-foil has an inner surface facing said blower with a radius equal to the radius of said air guide at about 35 degrees from said cut-off.

4. The air-conditioning unit according to claim 1, wherein said air foil is located at a side of said fan toward said second end of said discharge port.

5. The air-conditioning unit according to claim 1, wherein said air foil intersects said discharge port generally at a lateral center of said discharge port.

6. The air-conditioning unit according to claim 1, wherein said air foil intersects said discharge port generally at the center of said air foil.

7. The air-conditioning unit according to claim 1, wherein said air foil is double-curved.

8. The air-conditioning unit according to claim 7, wherein said air foil has forward curved portion forming said leading edge and a backward curved portion forming said trailing edge.

9. The air-conditioning unit according to claim 7, wherein said air foil is generally S-shaped.

10. The air-conditioning unit according to claim 1, wherein said leading edge of said air foil is spaced a distance from the circumference of said blower equal to about eight percent of the diameter of said blower.

11. The air-conditioning unit according to claim 1, wherein said trailing edge of said air foil is generally centered in said discharge plenum in a vertical direction.

12. The air conditioning unit according to claim 1, wherein said air guide has a radius near said second end of said discharge port equal to less than about 150 percent of the diameter of the blower wheel.

13. The air conditioning unit according to claim 12, wherein said air guide has a radius near said second end of said discharge port equal to less than about 110 percent of the diameter of the blower wheel.

14. The air-conditioning unit according to claim 1, wherein said air-foil has a length in a longitudinal direction which is less than the length of said air guide and said discharge plenum in a longitudinal direction.

15. The air-conditioning unit according to claim 1, wherein said trailing edge of said air foil is spaced from the top wall of said discharge plenum allowing air to flow laterally across said air plenum.

16. An air-conditioning unit comprising:

a centrifugal blower for centrifugally blowing air having a generally horizontal axis a rotation; and a scroll including an elongated discharge plenum above said blower, an air guide about said blower for directing air exiting said blower to said discharge plenum through a discharge port having first and second ends, said air guide having a radius from said rotational axis of said blower which increases from a cutoff point near said first end of said discharge port to said second end of said discharge port, and a double-curved air foil effective to divert a portion of air exiting said blower toward said second end of said discharge port to equally distribute air across said discharge plenum, wherein at least a portion of said air foil is rearwardly curved and forming a trailing edge.

17. An air-conditioning unit comprising:

a centrifugal blower for centrifugally blowing air having a generally horizontal axis a rotation; and a scroll including an elongated discharge plenum above said blower, an air guide about said blower for directing air exiting said blower to said discharge plenum through a discharge port having first and second ends, said air guide having a radius from said rotational axis of said blower which increases from a cutoff point near said first end of said discharge port to said second end of said discharge port, and a double-curved air foil effective to divert a portion of air exiting said blower toward said second end of said discharge port to equally distribute air across said discharge plenum, wherein said air foil has forward curved portion forming said leading edge and a backward curved portion forming said trailing edge.

18. An air-conditioning unit comprising:

a centrifugal blower for centrifugally blowing air having a generally horizontal axis a rotation; and a scroll including an elongated discharge plenum above said blower, an air guide about said blower for directing air exiting said blower to said discharge plenum through a discharge port having first and second ends, said air guide having a radius from said rotational axis of said blower which increases from a cutoff point near said first end of said discharge port to said second end of said discharge and a double-curved air foil effective to divert a portion of air exiting said blower toward said second end of said discharge port to equally distribute air across said discharge plenum, wherein said air foil is generally S-shaped.

19. A compact room air-conditioning unit comprising:

a centrifugal blower for centrifugally blowing air having a generally horizontal axis a rotation; and a scroll including an elongated discharge plenum above said blower, an air guide about said blower for directing air exiting said blower to said discharge plenum through a discharge port having first and second ends, said air guide having a radius from said rotational axis of said blower which increases from a cutoff point near said first end of said discharge port to said second end of said discharge port, and a curved air foil located above said blower and at a side of said blower toward said second end of said discharge port, said air foil having a leading edge near said blower and a trailing edge in said discharge plenum effective to divert a portion of air exiting said blower toward said second end of said discharge port to equally distribute air across said discharge plenum, wherein at least a portion of said air foil is rearwardly curved and forming said trailing edge.

20. The compact room air-conditioning unit according to claim 19, wherein at least portion of said air-foil is forwardly curved.

21. The compact room air-conditioning unit according to claim 19, wherein said air foil is double-curved.

* * * * *